US006538377B1

(12) United States Patent
Scott et al.

(10) Patent No.: US 6,538,377 B1
(45) Date of Patent: Mar. 25, 2003

(54) MEANS FOR APPLYING CONDUCTING MEMBERS TO ARC TUBES

(75) Inventors: Curtis Edward Scott, Mentor, OH (US); Karthik Sivaraman, Mayfield Village, OH (US); Martin L. Panchula, University Heights, OH (US); Jack M. Strok, Garrettsville, OH (US)

(73) Assignee: General Electric Company, Schenectady, NY (US)

( * ) Notice: Subject to any disclaimer, the term of this patent is extended or adjusted under 35 U.S.C. 154(b) by 72 days.

(21) Appl. No.: 09/706,439

(22) Filed: Nov. 3, 2000

(51) Int. Cl.[7] ..... H01J 11/00
(52) U.S. Cl. ..... 313/567; 313/594; 313/601
(58) Field of Search ..... 313/567, 594, 313/601, 607, 234

(56) References Cited

U.S. PATENT DOCUMENTS

| | | | | |
|---|---|---|---|---|
| 3,424,935 A | | 1/1969 | Gungle et al. | |
| 3,828,214 A | | 8/1974 | Keeffe et al. | |
| 4,048,539 A | | 9/1977 | Walker et al. | |
| 4,053,809 A | | 10/1977 | Fridrich et al. | |
| 4,568,859 A | | 2/1986 | Houkes et al. | |
| 4,633,135 A | * | 12/1986 | Akins | 313/594 |
| 4,727,294 A | | 2/1988 | Houkes et al. | |
| 4,788,475 A | | 11/1988 | Jacobs | |
| 4,940,923 A | | 7/1990 | Kroontje et al. | |
| 5,047,693 A | | 9/1991 | Roberts et al. | |
| 5,059,868 A | | 10/1991 | El-Hamamsy et al. | |
| 5,079,479 A | * | 1/1992 | Weske et al. | 313/594 |
| 5,355,053 A | | 10/1994 | Zhu | |
| 5,541,480 A | | 7/1996 | Renardus et al. | |
| 5,757,137 A | | 5/1998 | Zhu | |
| 5,994,823 A | | 11/1999 | Okamura et al. | |
| 6,380,679 B1 | * | 4/2002 | Leers et al. | 313/594 |

OTHER PUBLICATIONS

Waymouth and Kusko, Monographs in Modern Electrical Technology (1971), Electric Discharge Lamps.
Nortup, Krasko and Lou, Journal of the Illuminating Engineering Society (Summer 1996), Pulse Start of Metal Halide Lamps for Improved Lumen Maintenance.
Byszewski and Budinger, Journal of the Illuminating Engineering Society (Summer 1990), Enhanced Starting of HID Lamps.
Wyner, Journal of the IES (Apr., 1979), Electrolysis of Sodium Through Alumina Arc Tubes.
Gregor, Li, Budinger and Byszewski, Journal of the Illuminating Engineering Society (Summer, 1996), Arc Tube Transparency Loss Due to Starting of HID Lamps.
Waymouth, Koury, Gungle and Peterson, Illuminating Engineering (Apr., 1967), Sodium Loss Processes in Metal Iodide Arc Lamps.
Cohen, Gungle, Gutta, Olson and Richardson, Journal of IES (Jul., 1974), Heat Starting a High–Pressure Sodium Lamp.
Collins and McVey, Lighting Design & Application (Sep., 1975), HPS Lamps for Use on HPM Ballasts.
Illuminating Engineering Society of North America Lighting Handbook, Eighth Edition, High–Intensity Discharge Lamps, p. 219.

* cited by examiner

*Primary Examiner*—Robert H. Kim
*Assistant Examiner*—Elizabeth Gemmell
(74) *Attorney, Agent, or Firm*—Fay, Sharpe, Fagan, Minnich & McKee, LLP

(57) ABSTRACT

An arc discharge lamp comprising an arc tube including a starting aid is described. The starting aid comprises at least one metal cermet coating applied to the surface of the arc tube, or a metal layer including refractory glass disposed over said cermet coating or said metal layer.

20 Claims, 1 Drawing Sheet

MEANS FOR APPLYING CONDUCTING MEMBERS TO ARC TUBES

BACKGROUND OF THE INVENTION

Field of the Invention

The present invention relates generally to lighting, and more specifically to an arc discharge lamp, such as a ceramic metal halide lamp. This invention relates particularly to a means for applying conducting members to high pressure arc discharge lamps, e.g. sodium (HPS) arc tubes.

Discharge lamps produce light by ionizing a fill such as a mixture of metal halides and mercury with an electric arc passing between two electrodes. The electrodes and the fill are sealed within a translucent or transparent discharge chamber which maintains the pressure of the energized fill material and allows the emitted light to pass through it. The fill, also known as a "dose" emits a desired spectral energy distribution in response to being excited by the electric arc. However, arc discharge lamps, particularly those of a high pressure variety are often difficult to start.

Presently known metallic starting aids for discharge lamps which are composed of tungsten metal reduce the required electrical breakdown voltage for starting. Unfortunately, they may not survive an air firing step used for cleaning ceramic arc tubes. Moreover, the tungsten oxidizes and becomes useless as a starting aid. A similar oxidation problem prevents application of metallic starting aids on arc tubes intended for open air operation, such as ceramic or quartz mercury arc tubes for light projectors. Another problem with existing metallic starting aids is that tungsten is relatively expensive. Lower cost metals have higher vapor pressure, which, in the vacuum established within the outer envelope of HPS lamps, would evaporate to produce bulb darkening and lumen depreciation.

Previous HPS starting aids have been designed in the form of a wire or coiled ignition filament. The starting aid is positioned in contact with the outer surface of the arc tube and is connected to one electrical power lead of the lamp. When an arc is formed and the lamp begins to warm up, the electrical connection is either removed from the starting aid, or the starting aid is moved away from the arc tube, so as to prevent electric field accelerated sodium diffusion through the arc tube wall. Such sodium diffusion would adversely affect the lamp life. One drawback to this method for applying an external conducting member to HPS arc tubes is the cost and complexity of designing lamps with movable starting aids. Furthermore, in the absence of direct attachment to the lamp, the starting aid may sag away from the arc tube due to the high temperature of operation. If the starting aid is not in direct contact with the arc tube, anywhere along its length, the starting voltage increases. Additionally, these switches are typically attached to the lamp frame, resulting in heating by radiation, rather than by conduction. This results in variation of lamp performance depending on the wattage of different lamps.

It would therefore be desirable to find a means for applying an external conducting member to arc tubes which would overcome the above mentioned problems.

SUMMARY OF THE INVENTION

The present invention provides an arc discharge lamp comprising an arc tube including a starting aid. The starting aid comprises at least one metal cermet coating applied to the surface of the arc tube, or a metal layer applied to the surface of the arc tube with refractory glass disposed over the metal cermet or metal layer.

In another embodiment of the present invention, a method for forming an arc discharge lamp is provided. This method comprises binding a metal starting aid to an arc tube with refractory glass.

In a further embodiment of the present invention, the starting aid comprises a mixture of two or more metals.

DETAILED DESCRIPTION OF THE PREFERRED EMBODIMENTS

Figure 1:
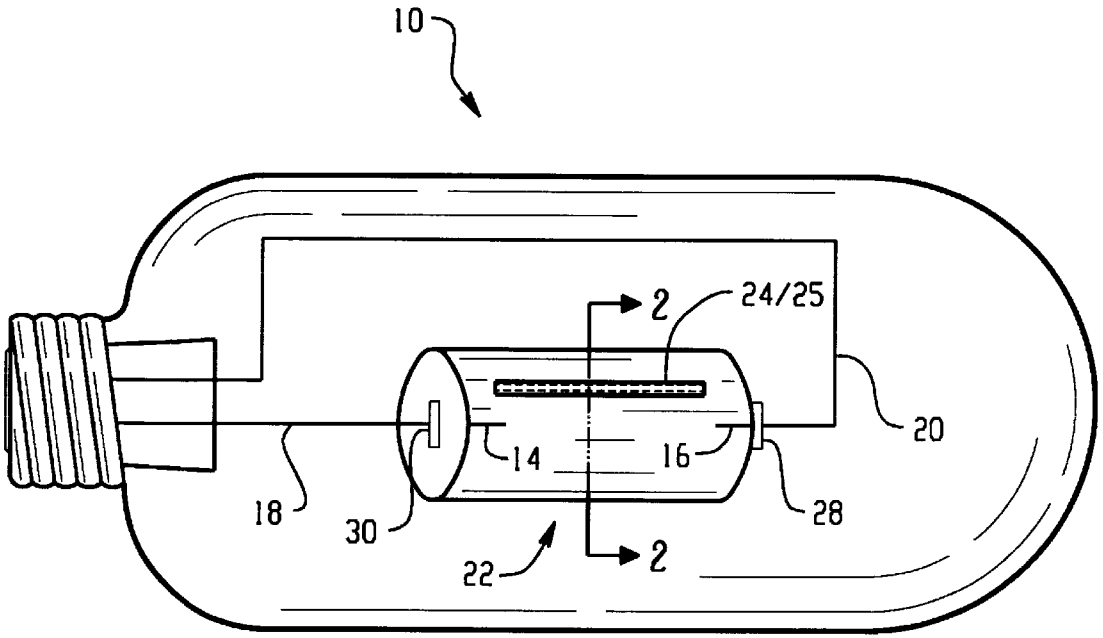
FIG. 1 illustrates a light source including a ceramic discharge chamber with a starting aid according to an exemplary embodiment of the invention.

Referring now to FIG. 1, a discharge lamp 10, such as a high pressure sodium lamp, according to an exemplary embodiment of the invention is depicted. The discharge lamp 10 includes a discharge chamber 12 which houses two electrodes 14, 16 and a fill (not shown). The electrodes 14, 16 are connected to conductors 18, 20 which apply a potential difference across the electrodes. In operation, the electrodes 14, 16 produce an arc which ionizes the fill in discharge chamber 12. The emission characteristics of the light produced by the plasma depend primarily on the constituents of the fill material, the current through the electrodes, the temperature distribution of the chamber, the pressure in the chamber, and the geometry of the chamber. For a ceramic metal halide lamp, the fill material typically comprises a mixture of mercury, a rare gas such as argon or xenon and a metal halide such as NaI, $ThI_3$, or $DyI_3$. Of course, other examples of fills are well known in the art.

As shown in FIG. 1, the discharge chamber 12 comprises a central body portion 22 with an attached starting aid 24. The ends of the electrodes 14, 16 are typically located near the opposite ends of the body portion 22. The electrodes are connected to a power supply by the conductors 18, 20, which are disposed through each seal 28, 30. The electrodes typically comprise tungsten. The conductors typically comprise molybdenum and niobium, the latter having a thermal expansion coefficient close to that of the ceramic (usually alumina) used to construct the discharge chamber to reduce thermally induced stresses on the seals 28, 30.

The discharge chamber 12 is sealed at the ends of the body portion with seal members 28, 30. Seal members 28, 30 typically comprise a disposium-alumina silica glass and can be formed as a glass frit in the shape of a ring around one of the conductors, e.g. 18, and aligned vertically with the discharge chamber 12, and melted to flow down over the conductor 18 and form a seal between the conductor 18 and the body portion 22. The discharge chamber is then turned upside down to seal the other end of the body portion 22 after being filled with the dose.

The starting aid of the present invention is in the form of a metal layer 24 bound to the body of the discharge tube 22 by refractory glass 25. The metal layer 24 serves as a starting aid and extends substantially between the main electrodes 14, 16.

Figure 2:
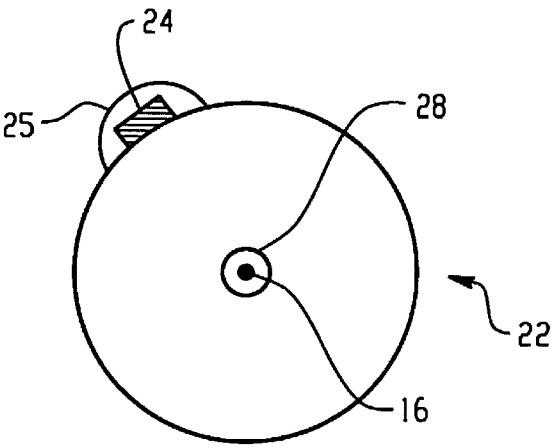
FIG. 2 illustrates a cross section of the discharge body 22 shown in FIG. 1.

With reference to FIG. 2, a cross section of the body of the discharge chamber 22 is shown. An electrode 16 is located near the end of the body 22, and the seal 28 is shown behind and around the electrode. The starting aid 24 is shown as a metal strip 24 covered with refractory glass layer 25 on the surface of the body 22.

The body of the discharge chamber 22 can be constructed by forming a mixture of ceramic powder and a binder into a hollow cylinder. Typically, the mixture comprises about 95–98 weight % ceramic powder and about 2–5 weight % organic binder. The ceramic powder may comprise alumina, $Al_2O_3$ (having a purity of at least 99.98%) in a surface area of about 2–10 meters$^2$ per gram. The alumina powder may be doped with magnesia to inhibit grain growth, for example, an amount equal to 0.03% to 0.2%, preferably 0.05% by weight of the alumina. Other ceramic materials which may be used include nonreactive refractory oxides and oxynitrides such as yttrium oxide, hafnium oxide and solid solutions and components with alumina such as yttrium aluminum garnet, aluminum oxynitride, and aluminum nitride. Binders which may be used individually or in combination of inorganic polymers such as polyols, polyvinyl alcohol, vinylacetates, acrylates, cellulosics, and polyethers. Subsequent to die pressing, the binder is removed from the green part typically by a thermal-treatment, to form a bisque fired part. Thermal treatment may be conducted, for example, by heating the green part in air from room temperature to a maximum temperature from about 980–1100° C. over 4 to 8 hours, then holding the maximum temperature for 1 to 5 hours, and then cooling the part. After thermal treatment, the porosity of the bisque fired part is typically about 40–50%.

While the invention has been described with reference to ceramic arc tubes, it should be noted that the present invention would be equally applicable to discharge lamps with quartz arc tubes.

The metal starting aid strip may be bound to the surface of the arc tube after the ceramic arc tube has been sintered. The metal used for the starting aid may be selected from tungsten, molybdenum, and mixtures thereof. The metal may be in various forms. The metals are preferably in the form of a wire or small particles. In deposited form, the metal starting aid will extend at least the distance between electrode tips and will have a width between about 0.1 and 1 mm and a height between about 0.1 and 1 mm, depending upon the overall dimension of the tube.

The metal starting aid strip is bound to the presintered arc tube by a refractory glass matrix. The glass matrix is selected from alumina, silica, magnesia, calcia, boria, and mixtures thereof. Of course, it is preferable that the refractory glass be translucent or transparent to allow the light emitted by the lamp to pass through.

In the embodiment described, the glass layer should be of sufficient thickness to protect the metal starting aid from oxidation. Preferably, the glass layer will be between about 0.1 and 1000 $\mu$m thick, more preferably between about 0.1 and 100 $\mu$m thick, and most preferably between about 0.1 and 10 $\mu$m thick. The glass must also exhibit a melting point in excess of about 1000° C., preferably greater than about 1100° C., and most preferably greater than about 1200° C. The refractory glass of the present invention will also preferably have a thermal expansion coefficient which matches that of the arc tube body. This will prevent flaking of the covering and metal which would lower the lifetime of the lamp.

In an alternative embodiment, the conductive metal strip may comprise a single layer of combined refractory glass and metal, i.e. a cermet, applied to the ceramic body before final sintering. Moreover, the refractory glass may have metal particles dispersed throughout the matrix to serve as the starting aid strip for the lamp. Moreover, the cermet comprises a refractory glass matrix having conductive metal disposed therein. Exemplary refractory materials include alumina, zirconia, magnesia, silica, and mixtures thereof. Exemplary metals include Mo, W, and mixtures thereof. Preferably the cermet will comprise between about 30 and 80% metal and between about 20 and 70% refractory material. The embodiment wherein the starting aid 24 comprises electrically conducting cermet also benefits from a refractory layer 25 for oxidation protection.

According to either embodiment, the lamps of the present invention contain conductive starting aids which are capable of surviving an air firing step for arc tube cleaning, such as temperatures exceeding 750° C. for several minutes to remove organic surface contaminants. Preferably, the starting aids can survive thousands of hours of operation in air. Furthermore, they will permit the use of metals, such as molybdenum, in a vacuum environment. Furthermore, the binding/protection function of the refractory glass may facilitate the use of higher vapor pressure, and less expensive, metals.

Although the invention has been described with reference to exemplary embodiments, various changes and modifications can be made without departing from the scope and spirit of the invention as defined by the appended claims.

We claim:

1. An arc discharge lamp comprising an arc tube including a starting aid, said starting aid comprising a metal layer applied to the surface of the arc tube, including a refractory glass disposed over and in contact with said metal layer.

2. The lamp of claim 1 wherein said metal is selected from tungsten and molybdenum.

3. The lamp of claim 1 wherein said starting aid is stable to temperatures greater than about 800° C.

4. The lamp of claim 1 wherein said refractory glass serves as a binding agent to the arc tube.

5. The lamp of claim 1 wherein said arc tube is comprised of ceramic or quartz.

6. The lamp of claim 1 wherein said metal layer is in the form of a wire.

7. The lamp of claim 1 wherein said arc discharge lamp is a high pressure sodium lamp.

8. The lamp of claim 1 wherein said refractory glass is selected from the group consisting of alumina, magnesia, silica, calcia, boria, zirconia, and mixtures thereof.

9. The lamp of claim 1 wherein said metal layer is applied after the lamp arc tube has been formed and densified.

10. A method for forming an arc discharge lamp comprising binding a metal starting aid to an arc tube with refractory glass.

11. The method of claim 10 wherein said starting aid is selected from one of the groups consisting of tungsten, molybdenum, and mixtures thereof.

12. The method of claim 10 wherein said starting aid is in the form of particles dispersed in a glass matrix, a fine refractory metal wire that uses the glass as a binding agent, or metal covered with a glass matrix.

13. The method of claim 10 wherein said starting aid is stable at temperatures between about 700 and 1100° C.

14. The method of claim 10 wherein said arc tube is comprised of a ceramic arc tube.

15. The method of claim 10 wherein said arc tube is comprised of a quartz arc tube.

16. The method of claim 10 wherein said arc discharge lamp comprises a high pressure sodium lamp.

17. An arc discharge lamp comprising an arc tube including a starting aid, said starting aid comprising a cermet coating applied to the surface of the arc tube, including a refractory glass disposed over said cermet coating.

18. The lamp of claim 17, wherein said cermet comprises metal particles disposed in a refractory material matrix.

19. The lamp of claim 18, wherein said metal comprises at least about 30% of said cermet.

20. The lamp of claim 17, wherein said cermet comprises tungsten or molybdenum and alumina.

* * * * *